US005560749A

United States Patent [19]

Madison et al.

[11] Patent Number: 5,560,749

[45] Date of Patent: Oct. 1, 1996

[54] POLYMERIC BLEACH PRECURSORS AND METHODS OF BLEACHING SUBSTRATES

[75] Inventors: Stephen A. Madison, New City; Pamela C. Lam, Congers, both of N.Y.

[73] Assignee: Lever Brothers Company, Division of Conopco, Inc., New York, N.Y.

[21] Appl. No.: 468,591

[22] Filed: Jun. 6, 1995

[51] Int. Cl.[6] ..... D06L 3/02

[52] U.S. Cl. ..... 8/111; 252/186.38; 525/328.2; 526/304; 510/281; 510/313; 510/375; 510/378; 510/191; 510/238; 510/239

[58] Field of Search ..... 8/111; 252/102, 252/186.38; 526/304; 525/328.2, 387

[56] References Cited

U.S. PATENT DOCUMENTS

| | | | |
|---|---|---|---|
| 3,127,233 | 3/1964 | Lowes | 8/111 |
| 3,779,931 | 12/1973 | Fries et al. | 252/102 |
| 4,178,263 | 12/1979 | Priddy | 8/111 |
| 4,483,778 | 11/1984 | Thompson et al. | 252/186.38 |
| 4,486,327 | 12/1984 | Murphy et al. | 252/186.38 |
| 4,912,147 | 3/1990 | Pfoehler et al. | 524/460 |
| 4,957,647 | 9/1990 | Zielske | 252/186.38 |
| 4,978,770 | 12/1990 | Aoyagi et al. | 252/186.38 |
| 5,401,435 | 3/1995 | Burzio et al. | 252/186.38 |
| 5,482,515 | 1/1996 | Madison et al. | 8/111 |

*Primary Examiner*—Prince Willis, Jr.
*Assistant Examiner*—James M. Silbermann
*Attorney, Agent, or Firm*—Milton L. Honig

[57] ABSTRACT

A bleaching composition and method is described that includes contacting a substrate with a peroxygen compound and a polymeric bleach precursor which has a monomer repeating unit of the structure:

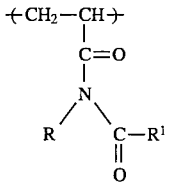

wherein R is hydrogen or a $C_1$–$C_{20}$ radical selected from the group consisting of alkyl, cycloalkyl, alkenyl, cycloalkenyl and aryl radicals; and $R^1$ is a $C_1$–$C_{40}$ radical selected from the group consisting of alkyl, cycloalkyl, alkenyl, cycloalkenyl and aryl radicals.

9 Claims, No Drawings

POLYMERIC BLEACH PRECURSORS AND METHODS OF BLEACHING SUBSTRATES

BACKGROUND OF THE INVENTION

1. Field of the Invention

The invention relates to polymeric bleach precursors which are non-sensitizing to the skin.

2. The Related Art

Active oxygen-releasing materials are normally only able to effect removal of stain and soil from substrates at relatively high temperatures. The art has partially solved the temperature problem through the use of activators. These activators, also known as bleach precursors, often appear in the form of carboxylic acid esters or amides. In an aqueous liquor, hydroperoxide anions generated from hydrogen peroxide react with the ester or amide to generate a corresponding peroxyacid. Commercial application of this technology is found in certain fabric bleaching detergent powders incorporating tetraacetylethylenediamine (TAED) and sodium nonanoyloxybenzene sulfonate (SNOBS).

Great care must be exercised in the manufacturing process to avoid contact with precursors because of potential skin sensitization. This medical condition is particularly evident with sulfophenyl esters because a highly efficient leaving group, the sulfophenyl moiety, is generated which through its reactivity causes sensitization. It has been speculated that the precursors penetrate the skin and react with proteins in the body to give an acylated protein. These acylated proteins likely stimulate a T-cell response resulting in irritancy and/or skin sensitization. The problem is particularly acute in the manufacturing process wherein workers are potentially exposed to high levels of the precursor.

Accordingly, it is an object of the present invention to provide a bleaching system and a precursor for such system exhibiting little or no skin sensitization.

A further object of the present invention is to provide a bleaching system and precursors of improved efficacy in removing stains from substrates.

Still a further object of the present invention is to provide a method for bleaching stained substrates such as clothes, household hard surfaces including sinks, toilets and the like, and even dentures, with a precursor of relatively low skin sensitization capability.

Other objects of the present invention will become apparent through the following summary, detailed description and examples.

SUMMARY OF THE INVENTION

A bleaching composition is provided comprising:

(i) from 1 to 60% by weight of a peroxygen compound; and (ii) from 0.1 to 40% of a bleach precursor which is a polymer or copolymer formed from a monomer repeating unit of structure:

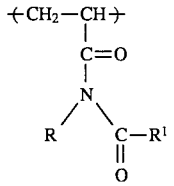

wherein R is hydrogen or a $C_1$–$C_{20}$ radical selected from the group consisting of alkyl, cycloalkyl, alkenyl, cycloalkenyl and aryl radicals; and $R^1$ is a $C_1$–$C_{40}$ radical selected from the group consisting of alkyl, cycloalkyl, alkenyl, cycloalkenyl and aryl radicals.

DETAILED DESCRIPTION

Now it has been found that certain acrylamide type polymers and copolymers can operate as bleach precursors and be non skin sensitizing. The polymer or copolymer will be formed from a monomer repeating unit of structure:

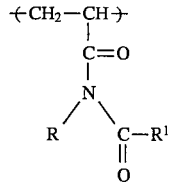

wherein R is hydrogen or a $C_1$–$C_{20}$ radical selected from the group consisting of alkyl, cycloalkyl, alkenyl, cycloalkenyl and aryl radicals; and $R^1$ is a $C_1$–$C_{40}$ radical selected from the group consisting of alkyl, cycloalkyl, alkenyl, cycloalkenyl and aryl radicals.

R and $R^1$ may either be substituted or unsubstituted. The term "substituted" is defined in relation to R and $R^1$ as a substituent which is a nitro, halo, cyano, $C_1$–$C_{20}$ alkyl, amino, aminoalkyl, thioalkyl, sulfoalkyl, carboxyester, hydroxy, $C_1$–$C_{20}$ alkoxy, polyalkoxy and $C_1$–$C_{40}$ quaternary di- or trialkylammonium function.

Polymers and copolymers of the present invention may have a molecular weight ranging from 500 to 5 million, preferably from 5,000 to 500,000, more preferably from 15,000 to 100,000, optimally from 25,000 to 60,000 weight average molecular weight.

Most preferred is where R is a $C_1$–$C_3$, particularly a methyl radical and $R^1$ is a $C_1$–$C_8$ alkyl, phenyl or benzyl radical substituted with a quaternary ammonium radical, particularly a trimethylammonium group.

Amounts of the precursor may range from 0.1 to 40%, preferably from 1 to 20%, optimally from 2 to 10% by weight.

A peroxygen compound is necessary for reaction with the precursor to generate a peroxy bleach. A variety of peroxygen compounds, serving as a source of hydroperoxide anion, are well known in the art. They include the alkali metal peroxides, organic peroxides such as urea peroxide, and inorganic persalts, such as the alkali metal perborates, percarbonates, perphosphates, persilicates and persulfates. Mixtures of two or more such compounds may also be suitable. Particularly preferred is sodium perborate tetrahydrate and, especially, sodium perborate monohydrate. Sodium perborate monohydrate is preferred because it has excellent storage stability while also dissolving very quickly in aqueous solutions.

Alkylhydroperoxides are another suitable classes of peroxygen compounds. Examples of these materials include cumene hydroperoxide and t-butyl hydroperoxide.

Under certain circumstances, hydrogen peroxide itself may directly be employed as the peroxygen compound.

The peroxygen compound will be present from 1 to 60%, preferably from 1.5 to 25%, optimally from 2 to 10% by weight. Relative molar ratios of peroxygen compound to precursor will range from 1000:1 to 1:20, preferably 200:1 to 3:1.

Bleach systems of the present invention may be employed for a wide variety of purposes, but are especially useful in the cleaning of laundry. When intended for such purpose, the peroxygen compound and precursor of the present invention will usually also be combined with surface-active materials, detergency builders and other known ingredients of laundry detergent formulations.

The surface-active material may be naturally derived, or synthetic material selected from anionic, nonionic, amphoteric, zwitterionic, cationic actives and mixtures thereof. Many suitable actives are commercially available and are fully described in the literature, for example in "Surface Active Agents and Detergents", Volumes I and II, by Schwartz, Perry and Berch. The total level of the surface-active material may range up to 50% by weight, preferably being from about 0.5 to 40% by weight of the composition, most preferably 4 to 25%.

Synthetic anionic surface-actives are usually water-soluble alkali metal salts of organic sulfates and sulfonates having alkyl radicals containing from about 8 to about 22 carbon atoms.

Examples of suitable synthetic anionic detergent compounds are sodium and ammonium alkyl sulfates, especially those obtained by sulfating higher ($C_8$–$C_{18}$) alcohols produced for example from tallow or coconut oil; sodium and ammonium alkyl ($C_9$–$C_{20}$) benzene sulfonates, particularly sodium linear secondary alkyl ($C_{10}$–$C_{15}$) benzene sulfonates; sodium alkyl glyceryl ether sulfates, especially those ethers of the higher alcohols derived from tallow coconut oil and synthetic alcohols derived from petroleum; sodium coconut oil fatty acid monoglyceride sulfates and sulfonates; sodium and ammonium salts of sulfuric acid esters of higher ($C_9$–$C_{18}$) fatty alcohol-alkylene oxide, particularly ethylene oxide reaction products; the reaction products of fatty acids such as coconut fatty acids esterified with isethionic acid and neutralized with sodium hydroxide; sodium and ammonium salts of a fatty acid amides of methyl taurine; alkane monosulfonates such as those derived by reacting alpha-olefins ($C_8$–$C_{20}$) with sodium bisulfite and those derived by reacting paraffins with $SO_2$ and $Cl_2$ and then hydrolyzing with a base to produce a random sulfonate; sodium and ammonium $C_7$–$C_{12}$ dialkyl sulfosuccinates; and olefinic sulfonates, which term is used to describe the material made by reacting olefins, particularly $C_{10}$–$C_{20}$ alpha-olefins, with $SO_3$ and then neutralizing and hydrolyzing the reaction product. The preferred anionic detergent compounds are sodium ($C_{11}$–$C_{15}$) alkylbenzene sulfonates; sodium ($C_{16}$–$C_{18}$) alkyl sulfates and sodium ($C_{16}$–$C_{18}$) alkyl ether sulfates.

Examples of suitable nonionic surface-active compounds which may be used preferably together with the anionic surface-active compounds, include in particular, the reaction products of alkylene oxides, usually ethylene oxide, with alkyl ($C_6$–$C_{22}$) phenols, generally 2–25 EO, i.e. 2–25 units of ethylene oxide per molecule; the condensation products of aliphatic ($C_8$–$C_{18}$) primary or secondary linear or branched alcohols with ethylene oxide, generally 2–30 EO, and products made by condensation of ethylene oxide with the reaction products of propylene oxide and ethylene diamine. Other so-called nonionic surface-actives include alkyl polyglycosides, polyhydroxy fatty acid amides (e.g. $C_{12}$–$C_{18}$ N-methyl glucoside), long chain tertiary amine oxides, long chain tertiary phosphine oxides and dialkyl sulfoxides.

Amounts of amphoteric or zwitterionic surface-active compounds can also be used in the compositions of the invention but this is not normally desired owing to their relatively high cost. If any amphoteric or zwitterionic detergent compounds are used, it is generally in small amounts in compositions based on the much more commonly used synthetic anionic and nonionic actives.

The detergent compositions of the invention will normally also contain a detergency builder. Builder materials may be selected from (1) calcium sequestrant materials, (2) precipitating materials, (3) calcium ion-exchange materials and (4) mixtures thereof.

In particular, the compositions of the invention may contain any one of the organic or inorganic builder materials, such as sodium or potassium tripolyphosphate, sodium or potassium pyrophosphate, sodium or potassium orthophosphate, sodium carbonate, the sodium salt of nitrilotriacetic acid, sodium citrate, carboxymethylmalonate, carboxymethyloxysuccinate, tartrate mono- and di-succinates, oxydisuccinate, crystalline or amorphous aluminosilicates and mixtures thereof.

Polycarboxylic homo- and copolymers may also be included as builders and to function as powder structurants or processing aids. Particularly preferred are polyacrylic acid (available under the trademark Acrysol from the Rohm and Haas Company) and acrylic-maleic acid copolymers (available under the trademark Sokalan from the BASF Corporation) and alkali metal or other salts thereof.

These builder materials may be present at a level of, for example, from 1 to 80% by weight, preferably from 10 to 60% by weight.

Upon dispersal in a wash water, the initial amount of peroxygen compound should range anywhere from 0.05 to 250 ppm active oxygen per liter, preferably from 1 to 50 ppm. Precursor may be present in the wash medium in an amount from 0.05 to 200 ppm per liter, preferably from 5 to 100 ppm. Surfactant should be present in the wash water from about 0.05 to 1.0 grams per liter, preferably from 0.15 to 0.20 grams per liter. When present, the builder amount will range from 0.1 to 3.0 grams per liter.

Apart from the components already mentioned, the detergent compositions of the invention can contain any of the conventional additives in the amounts in which such materials are normally employed in detergent compositions. Examples of these additives include lather boosters such as alkanolamides, particularly the monoethanolamides derived from palmkernel fatty acids and coconut fatty acids, lather depressants such as alkyl phosphates and silicones, antiredeposition agents such as sodium carboxymethylcellulose and alkyl or substituted alkylcellulose ethers, other stabilizers such as ethylene diamine tetraacetic acid, fabric softening agents, inorganic salts such as sodium sulfate and usually present in very small amounts, fluorescent whitening agents, perfumes, enzymes such as proteases, cellulases, lipases and amylases, germicides and colorants.

The bleaching system described herein is useful in a variety of cleaning products. These include laundry detergents, laundry bleaches, hard surface cleaners, toilet bowl cleaners, automatic dishwashing compositions and even denture cleaners. The bleaching system of the present can be introduced in a variety of product forms including powders, on sheets or other substrates, in pouches, in tablets or in nonaqueous liquids such as liquid nonionic detergents.

The following examples will more fully illustrate the embodiments of this invention. All parts, percentages and proportions referred to herein and in the appended claims are by weight unless otherwise illustrated.

EXAMPLE 1

Synthesis of Poly-[N-methyl-N-(3-N,N,N-trimethylammoniomethyl)benzoylacrylamide, Chloride] [designated Poly (QP15 Acrylamide]

A. N-Methylacrylamide 250 mL acetonitrile was introduced into a 500 mL round-bottomed flask fitted with a two-hole stopper where one hole was occupied with an inlet gas dispersion tube and the other hole an outlet tube leading to a trap containing 6N hydrochloric acid. The reaction vessel was then chilled to −20° C. with a dry ice/acetone bath. An anhydrous methylamine lecture bottle was connected to the inlet tube and 27 g (0.87 mole, 10% molar excess) of methylamine was introduced into the cold acetonitrile. To the methylamine solution, 39.4 g (0.392 mole) of acryloyl chloride in 60 mL acetonitrile was added dropwise. Immediately after the addition, white fumes and precipitation were noted. Upon completion of the addition, the reaction slurry was allowed to warm to room temperature. After two hours at room temperature, the mixture was filtered by vacuum filtration. The filter cake was washed twice with fresh acetonitrile. NMR analysis confirmed that the filter cake was the by-product salt; N-methylammonium chloride. The filtrate was concentrated using rotary evaporator to give 35.4 g product (86% yield).

$^1$H NMR (relative to external TMS): acetone-D6: 5.4–6.4 ppm (m, 3H, vinyl protons); 2.6–2.8 ppm (d, 3H, N-methyl)

IR N—H band at 3300 cm$^{-1}$, carbonyl band at 1660–1680 cm$^{-1}$

B. Preparation of N-methyl-N-trimethylsilylacrylamide

N-methylacrylamide (50.9 g, 0.6 mole) and triethylamine (67 g, 0.67 mole) were added to 300 mL of acetonitrile in a 500 mL round-bottomed flask. The reaction vessel was fitted with a reflux condenser topped with a rubber stopper that contained two needles, one connected to a source of nitrogen gas and other to an oil bubbler. A solution of trimethylsilyl chloride (72.4 g, 0.67 mole) in a 50 mL acetonitrile was added dropwise to this mixture. A white precipitate formed almost immediately. The amount of precipitate continued to increase throughout the addition and the color of the solution changed from colorless to orange. After the addition was completed, the resulting slurry was allowed to stir at room temperature for six hours. The mixture was filtered using vacuum filtration in a dry bag filled with nitrogen. The white precipitate was collected as a filter cake. NMR-T60 analysis indicated the filter cake was the triethylammonium chloride, the expected by-product. The orange colored filtrate concentrated in vacuo gave a dark red material. The crude mixture was subjected to vacuum fractional distillation. The first fraction distilled at 22°–35° C. at 0.3 mm Hg. NMR analysis showed it was mostly acetonitrile and a small amount of product. The second fraction distilled at 35°–45° C. at 0.3 mm Hg and appeared to be the desired pure product on NMR analysis. The third fraction distilled at 70°–80° C. at 0.3 mm Hg. NMR analysis showed it was N-methyl acrylamide. The pot contained uncharacterized polymerized material as a black viscous material. The reaction gave about 45% yield.

$^1$H NMR (acetone-D6): 6.8–5.4 ppm (m, vinyl protons, 3H); 2.8 ppm (s, 3H, N-methyl); 0.2 ppm (s, trimethyl, 9H).

C. Poly-[N-methyl-N-(3-chloromethylbenzoyl)acrylamide]

11.5 g of N-methyl-N-trimethylsilylacrylamide was weighed into a 250 mL 3-necked round-bottomed flask in nitrogen glove bag. To this flask was added 15 mL of dry acetone. The flask was fitted with a water condenser topped with an nitrogen inlet and an outlet to an oil bubbler, a mechanical stirrer, an oil bath, and a hot plate stirrer. The reaction mixture was heated at reflux for half an hour. 0.05 g (0.5 mole %) of AIBN initiator was added to the mixture. Refluxing was continued for several hours. The mixture became viscous and yellow. The reaction progress was monitored by proton NMR. After 14 hours of heating, the mixture when analyzed by NMR showed that the vinyl peaks had completely disappeared and concommitantly the trimethylsilyl peak became broader. At this time 15.1 g (0.08 mole) of 3-chloromethylbenzoyl chloride (ex. Fluka) and 15 mL of acetone was added to the reaction mixture. The mixture was heated and the course of the reaction was monitored by NMR and IR spectroscopy. After another 8–10 hours, the reaction mixture became a yellow gel-like material. NMR showed approximately 70% of the acid chloride had been converted to the desired product. It was also confirmed by IR analysis. Solvent and residual 3-(chloromethyl)benzoyl chloride were decanted off the gel. The rubbery material was washed with acetone until a yellow-beige solid resulted. FT-NMR analysis of this solid product indicated the polymer was 72% functionalized. The 9 g of recovered product amounted to a 50% yield.

$^1$H-NMR (acetone-D6): 7.0–8.0 ppm (m, aromatic, 4H); 4.5–4.8 ppm (s, 2H, —$CH_2$—); 2.9–3.4 ppm (s, 3H, N-methyl); 1.4–2.8 ppm (m, polymer back-bone).

IR (nujol): carbonyl band at 1695 cm$^{-1}$

D. Preparation of Poly [QP15 Acrylamide]

50 mL of acetone was introduced into a 500 mL cylindrical flask topped with a two-holed rubber stopper. A gas dispersion tube serving as the inlet was placed through one hole and in the other hole was arranged an exit tube to a trap containing 6N hydrochloric acid. The reaction vessel was then chilled to −5° C. with salt/ice bath. To the inlet tube, a lecture bottle of anhydrous trimethylamine was connected and then 1.86 g (0.0316 mole) of trimethylamine was delivered to the cold acetone. Poly-[N-methyl-N-( 3-(chloromethyl)benzoyl)acrylamide] was dissolved in a solution of 150 mL of toluene and 25 mL of acetone by slight heating on a steam bath. The chloropolymer solution was then added in one portion to the cold amine solution. After the addition was completed the two-holed stopper was replaced with a solid stopper and the flask tightly clamped. The reaction solution was allowed to warm to room temperature where it was then kept at room temperature for an additional 20 hours. N.B. Precipitate was noted two hours into this reaction period. The solvent was then decanted and the precipitate washed several times with ether. $^1$H-NMR analysis of the isolated solid confirmed that this material, isolated in 80% yield, was the desired product.

$^1$H-NMR: ($D_2O$) 7.0–7.8 ppm (m, 4H, aromatic); 4.1–4.5 ppm (s, 2H, $CH_2$—); 2.7–3.3 ppm (s, trimethyl group); 1.2–2.5 ppm (m, polymer back-bone).

EXAMPLE 2

Synthesis of Poly-[N-methyl-N-(4-(N,N,N-trimethylammonio) butyryl)acrylamide] [designation Poly (Q4 Acrylamide)]

A. Preparation of N-Methyl-N-(4-bromobutyryl)acrylamide

In a nitrogen glove bag 7.27 g (0.05 mole) of N-methyl-N-trimethylsilylacrylamide was placed in a one-necked flask. The flask was fitted with an additional funnel topped with a drying tube. With the flask contents cooled to ice/water temperatures, 9.28 g (0.05 mole) of 4-bromobutyryl chloride was added dropwise through a dropping funnel to the flask over a period of half an hour. The resulting yellow clear mixture was stirred for an additional two hours. The disappearance of the acyl chloride carbonyl band (1800 $cm^{-1}$) and the increase in intensity of the product amide band (1670 $cm^{-1}$) was monitored by IR. The by-product trimethylsilyl chloride was removed in vacuo to give 13 g of product. It was used in the next step without further purification.

$^1$H-NMR (acetone-D6): 5.1–6.7 ppm (m, vinyl protons, 3H); 3.0–3.2 ppm (t, $CH_2$, 2H), 3 ppm (s, N-methyl, 3H); 1.4–2.6 ppm (m, $CH_2$—$CH_2$, 4H).

B. Preparation of Poly[N-methyl-N-(4-bromobutyryl)acrylamide]

A two-necked flask was fitted with a water condenser, nitrogen inlet, stir bar and arranged in an oil bath supported on a hot plate stirrer. To the flask was added 15.5 g of N-methyl-N-(4-bromobutyryl)amide and 15 mL of acetonitrile. The resulting yellow mixture was heated to reflux. Then 0.15 g AIBN dissolved in 5 mL acetonitrile was added. After 20 hours at reflux, NMR analysis of the reaction mixture showed 90% polymerization, as indicated by the disappearance of the vinyl protons. At this time another 0.015 g (0.1%) of AIBN was added. After an hour no further reaction was noted by NMR. Acetonitrile was removed in vacuo and a brown viscous material was isolated. The viscous material was treated with ether and washed until a pinkish colored granular solid was obtained. The recovered solid weighed 8.5 g.

$^1$H-NMR (acetonitrile-$D_6$): 1.4–3.6 ppm (m, alkyl and polymer back-bone); 2.95 ppm (s, N-methyl).

C. Preparation of N-Methyl-N-(4-(N,N,N-trimethylammonio)butyryl)acrylamide 15 mL of acetonitrile was introduced into a 250 mL cylindrical flask topped with a two-holed rubber stopper. A gas dispersion tube serving as the inlet was placed through one hole and in the other hole a exit tube to a trap containing 6N hydrochloric acid was arranged. The flask was chilled to 0° C. 2.1 g of trimethylamine was then bubbled into the chilled acetonitrile. To this amine solution, a solution of 8.5 g poly-[N-methyl-N-( 4-bromobutyryl)acrylamide] was added to 20 mL of acetonitrile. The yellow mixture was allowed to stand at room temperature for 16 hours. The colored mixture eventually gave a golden yellow material at the bottom of the flask. After ether was added to the mixture, a cloudy brown tacky viscous material was immediately formed at the bottom. This tacky material was washed several times with ether until a granular solid was obtained. The solid was isolated by vacuum filtration. NMR of the filter cake indicated the desired product. The product had a pH of 7 in water. 5 g product was recovered.

$^1$H-NMR ($D_2O$): 3.0 ppm (s, 9H, trimethylammonio group); 2.8 ppm (s, 3H, N-methyl); 2.5–3.2 ppm (m, 6H, methylene of the butyryl); 1.6–2.2 ppm (m, H from all the polymer back-bone).

EXAMPLE 3

Synthesis of Poly-[N-methyl-N-(4-(N,N,N-trimethylammonio) butyryl)acrylamide-co-N-octanoylacrylamide] Bromide [designation Poly (C8-co-Q4)]

A. Preparation of N-methyl-N-octanoylacrylamide

To 4.1 g (0.0252 mole) of N-methyl-N-trimethylsilylacrylamide was added dropwise 3.66 g of octanoyl chloride at 0° C. After the addition was completed, the mixture was allowed to stir for 45 minutes at room temperature. Complete conversion was indicated by IR after 2 hours and 45 minutes.

$^1$H-NMR: 3 ppm and 3.6 ppm (2 triplets, Cl—$CH_2$—$CH_2$), 2.4 ppm (s, N—$CH_3$), 1.8 ppm (s, $CH_3$—C=O).

B. Preparation of Poly-[N-methyl-N-octanoylacrylamide-co-N-methyl-N-(4-bromobutyryl)acrylamide]

The equipment and procedure was identical to that of Example 2, section B. 2.56 g (0.011 mole) of N-methyl-N-(4-bromobutyryl)acrylamide, 2.32 g of N-methyl-N-octanoyl acrylamide, and 0.0143 g of AIBN were used to produce 5.2 g of the desired product. The material formed was viscous and orange.

C. Preparation of Poly-(C8-co-Q4)

The above prepared material (section B) was treated with trimethylamine in a similar fashion as in Example 2, section C. 5.2 g of the material to be treated and 0.36 g of the trimethylamine were dissolved in 50 mL of acetone. The solid formed was white and nmr analytical results were consistent with the desired structure.

EXAMPLE 4

The formation of percarboxylic acid from the perhydrolysis of the quaternary substituted polymeric precursors were determined by the ice-titer method. All experiments were conducted at 40° C. The percarboxylic acid yields are reported in Table I.

TABLE I

Conditions: pH 10, 8:1 ratio of $H_2O_2$:precursor, 6.2 × $10^{-4}$M precursor concentrate.

| Product | Time (Hours) | % Perhydrolysis |
|---|---|---|
| Poly (QP15) | 1 | 57 |
| | 8 | 44 |
| | 15 | 32 |
| Poly (Q4) | 1 | 68 |
| | 8 | 45 |
| | 15 | 38 |
| Poly (C8-co-Q4) | 1 | 47 |
| | 8 | 32 |
| | 15 | 21 |

Stain bleaching experiments were conducted using 0.75 g of Concentrated "all" ® added to a wash pot and the pH of the solution constantly buffered. Washes were conducted at 40° C. for 15 minutes.

Stain bleaching was measured reflectometrically using a Colorgard System/05 Reflectometer. Bleaching was indicated by an increase in reflectance, reported as ΔΔR. In general, a ΔΔR of one unit is perceivable in a paired comparison while a ΔΔR of two units is perceivable monadically.

Results of the bleaching experiments are reported in Table II.

TABLE II

| PRECURSOR* | WEIGHT RATIO $H_2O_2$:PRECURSOR | ΔΔR |
|---|---|---|
| Poly (QP 15) | 8:1 | 7.5 |
| | 10:1 | 10 |
| Poly (Q4) | 8:1 | 10.5 |
| | 10:1 | 8 |
| Poly (C8-co-Q4) | 8:1 | 8 |
| | 10:1 | 6 |

*6.2 × $10^{-4}$M

EXAMPLE 5

Sensitization studies were conducted on Poly(QP 15) utilizing the Magnusson-Kligman Maximization Test. In this study 2 of 10 animals responded to a 5% solution during the first challenge and 0 of 10 animals responded in the second challenge.

Upon HPLC analysis this sample of Poly QP15 was found to have 1.1% of 3-(N,N,N-trimethylammoniomethyl)benzoic acid and 0.5% of 3-(N,N,N-trimethylammoniomethyl) benzamide. Because it was suspected that these impurities could cause a reaction as well in the test, a cross challenge with these two impurities was also performed. It was found that only the latter compound elicited a weak sensitization response.

The monomer analog of Poly QP15, N-methyl-N-(3-N,N,N-trimethylammoniomethyl)benzoyl- 2-(methyl)butyrylamide (Q5) was also prepared for comparative evaluation. The results of the Magnusson-Kligman Maximization Test which for this compound was conducted at a 10 fold lower concentration, i.e. as a 0.5% solution, showed that 6 of the 10 animals responded and thus could be classified as a strong sensitizer. The aforementioned test had to be carried out at a 10-fold reduced concentration relative to Poly QP15 because at a 5% concentration Q5 showed much more irritancy to the skin.

The foregoing description and Examples illustrate selected embodiments of the present invention and in light thereof various modifications will be suggested to one skilled in the art, all of which are within the spirit and purview of this invention.

What is claimed is:

1. A bleaching composition comprising:

(i) from 1 to 60% by weight of a peroxygen compound; and (ii) from 0.1 to 40% of a bleach precursor which is a polymer or copolymer formed from a monomer repeating unit of structure:

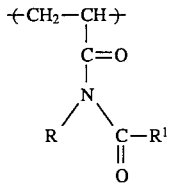

wherein R is hydrogen or a $C_1$–$C_{20}$ radical selected from the group consisting of alkyl, cycloalkyl, alkenyl, cycloalkenyl and aryl radicals; and $R^1$ is a $C_1$–$C_{40}$ radical selected from the group consisting of alkyl, cycloalkyl, alkenyl, cycloalkenyl and aryl radicals.

2. A composition according to claim 1 wherein the precursor is poly-(N-methyl-N-( 3-N,N,N-trimethylammoniomethyl)benzoylacrylamide).

3. A composition according to claim 1 wherein the precursor is poly-(N-methyl-N-( 4-N,N,N-trimethylammonio)butyryl)acrylamide).

4. A composition according to claim 1 wherein the precursor is poly-(N-methyl-N-( 4-N,N,N-trimethylammonio)butyryl)acrylamide-co-N-octanoyl acrylamide).

5. A method for bleaching a stained substrate, said method comprising contacting said stained substrate in an aqueous medium with a bleaching effective amount of a peroxygen compound and a bleach precursor which is a polymer or copolymer having a repeating monomer unit of the structure:

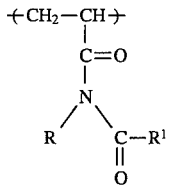

wherein R is hydrogen or a $C_1$–$C_{20}$ radical selected from the group consisting of alkyl, cycloalkyl, alkenyl, cycloalkenyl and aryl radicals; and $R^1$ is a $C_1$–$C_{40}$ radical selected from the group consisting of alkyl, cycloalkyl, alkenyl, cycloalkenyl and aryl radicals, said peroxygen compound to precursor being present in a molar ratio from 1,000:1 to 1:20.

6. A method according to claim 5 wherein said substrate is a fabric.

7. A method according to claim 5 wherein said substrate is selected from the group consisting of dishes, glassware and tableware.

8. A method according to claim 5 wherein said substrate is a denture.

9. A method for bleaching a stained substrate, said method comprising contacting said stained substrate in an aqueous medium with a bleaching effective amount of a peroxygen and a bleach precursor which is a polymer or copolymer having a repeating monomer unit whose structure is:

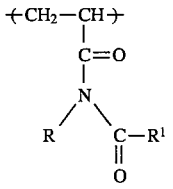

wherein R is hydrogen or a $C_1$–$C_{20}$ radical selected from the group consisting of alkyl, cycloalkyl, alkenyl, cycloalkenyl and aryl radicals; and $R^1$ is a $C_1$–$C_{40}$ radical selected from the group consisting of alkyl, cycloalkyl, alkenyl, cycloalkenyl and aryl radicals, said contacting occurring in said medium containing about 0.05 to about 250 ppm active oxygen per liter from the peroxygen compound and from 0.05 to 200 ppm per liter bleach precursor.

* * * * *